US007049928B2

(12) United States Patent
Yamada et al.

(10) Patent No.: US 7,049,928 B2
(45) Date of Patent: May 23, 2006

(54) RESISTOR AND METHOD OF MANUFACTURING THE SAME

(75) Inventors: Hiroyuki Yamada, Fukui (JP); Takeshi Iseki, Fukui (JP); Toshifumi Suejima, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/871,309

(22) Filed: May 30, 2001

(65) Prior Publication Data

US 2004/0012479 A1 Jan. 22, 2004

(30) Foreign Application Priority Data

May 30, 2000 (JP) ..... 2000-159843

(51) Int. Cl.
*H01C 10/00* (2006.01)

(52) U.S. Cl. ..... 338/195; 338/307; 338/283; 29/620

(58) Field of Classification Search ..... 338/307, 338/195, 292, 293, 283, 313; 29/620
See application file for complete search history.

(56) References Cited

U.S. PATENT DOCUMENTS

| | | | | |
|---|---|---|---|---|
| 2,438,205 | A * | 3/1948 | Coates | 338/309 |
| 3,282,730 | A * | 11/1966 | Johnston et al. | 338/195 |
| 3,359,467 | A * | 12/1967 | Cook | 338/309 |
| 3,512,254 | A * | 5/1970 | Jenkins | 338/195 |
| 3,669,733 | A * | 6/1972 | Allington | 427/555 |
| 3,778,744 | A * | 12/1973 | Brandi | 338/260 |
| 3,805,210 | A * | 4/1974 | Croset et al. | 338/308 |
| 4,238,205 | A * | 12/1980 | Geiger et al. | 451/123 |
| 4,297,670 | A * | 10/1981 | Solow | 338/195 |
| 4,429,298 | A * | 1/1984 | Oberholzer | 338/195 |
| 4,929,298 | A * | 5/1990 | Poel et al. | 156/414 |
| 5,321,382 | A * | 6/1994 | Mizukoshi et al. | 338/53 |
| 5,548,268 | A * | 8/1996 | Collins | 338/307 |
| 5,929,746 | A * | 7/1999 | Edwards, Jr. et al. | 338/320 |
| 6,189,767 | B1 * | 2/2001 | Haspeslagh | 228/123.1 |
| 6,292,091 | B1 * | 9/2001 | Kambara et al. | 338/195 |
| 6,322,711 | B1 * | 11/2001 | Chen | 216/16 |

FOREIGN PATENT DOCUMENTS

| | | |
|---|---|---|
| JP | 64-42102 | 2/1989 |
| JP | 01-137601 | 5/1989 |
| JP | 09-205004 | 8/1997 |

OTHER PUBLICATIONS

Handbook of ThickFilm Technology, Holmes Loasby, Ch. 1, pp. 1-5 (1976).*
Japanese patent to Kiyobumi, JP09-205004 machine translation (Aug. 1997).*
64-42102 patent abstracts Feb. 1989.*

* cited by examiner

*Primary Examiner*—Kyung Lee
(74) *Attorney, Agent, or Firm*—RatnerPrestia

(57) ABSTRACT

The resistor of the present invention comprises a substrate, a pair of electrodes, and a resistor element comprising rectangular sections connected to the pair of electrodes and a S-shaped section disposed between the rectangular sections and is free of trimming portion. At least one of the rectangular sections is trimmed to adjust the resistance. According to the construction of the present invention, a compact resistor of superior surge property can be obtained.

18 Claims, 2 Drawing Sheets

RESISTOR AND METHOD OF MANUFACTURING THE SAME

FIELD OF THE INVENTION

The present invention relates to a resistor having a superior surge property, which is used in electric devices. The present invention also relates to the method of manufacturing the resistor.

BACKGROUND OF THE INVENTION

Against a background of increasing miniaturization of electric devices, an increasing number of chip resistors are used in recent years. In addition, along with the growing demand of mounting electric devices by a surface mounting, carbon-film resistors with lead wires are actively replaced with chip resistors. Consequently, demands for new properties such as surge property have been increasing to chip resistors. In general, the resistance of a resistor can easily fluctuate when a surge voltage generated by static electricity or noise in the power source is applied. However, it is known that the longer and wider the resistor element, the less the resistance value fluctuates.

One of the well-known prior arts has been disclosed in the Japanese Patent Laid-open Publication No. H01-42102 (S64-42102). To reduce the noise of the resistor element, any number of slits are provided alternately from the two facing sides of the rectangular resistor element so that the current path in the resistor element becomes longer by a zigzag pattern.

The chip resistor disclosed in the Japanese Patent Laid-open Publication No. H09-205004 comprises a resistor element which is formed between a pair of electrodes by a printing or trimming method, or by both methods in combination, in a manner that the resistor element are bent three times or more between the two electrodes.

As shown in FIG. 2, however, in the case of the chip resistor disclosed in the Japanese Patent Laid-open Publication No. H01-42102 (S64-42102), when a slit 4 is not provided, a resistor element 3 becomes shorter. On the other hand, when a plurality of slits 4 are provided, the resistor element 3 becomes thinner, and is changed in resistive property by heat applied during the laser trimming processes, lowering its surge property. Conventionally, during the laser trimming, the resistor element 3, along with a substrate 1, is cut to form a groove that reaches under a surface of the substrate and has a bottom lower than the surface. Formation of five slits 4 by laser increases manhours, thus productivity decrease.

As shown in FIG. 3, with the prior art disclosed in the Japanese Patent Laid-open Publication No. H09-205004, the chip resistor can not be downsized with the printing method. In other words, when considering a required width of the resistor element and space between neighboring pattern, a resistor of size 2012 (2.0 mm×1.25 mm) for example, can only be bent once or twice. In FIG. 4, by the combination method of printing and trimming, a resistor element 8 with two turns is printed between electrodes 6 which are disposed on both ends of a substrate 5. In this case, due to alignment failure of printing, and smearing or sagging of the resistor element 8, spaces between the electrodes 6 and the resistor element 8 is filled, thus a desirable length of the resistor element can not be obtained. Furthermore, since there is no other trimmed section besides a trimming groove 9, ratio of the resistance adjustment is limited and production yield is low. The present invention aims to address the foregoing problems and to provide a compact resistor having a superior surge property.

SUMMARY OF THE INVENTION

The resistor of the present invention comprises:

a substrate;

a pair of electrodes disposed on the substrate; and a resistor element disposed between the electrodes.

The resistor element comprises rectangular sections connected to the pair of electrodes and a S-shape section which is located between the rectangular sections and is not provided with trimming grooves. Further, at least one of the rectangular sections has trimming groove for resistance adjustment.

According to the construction of the present invention, a compact resistor having a superior surge property can be obtained.

DETAILED DESCRIPTION OF THE INVENTION

The chip resistor in accordance with the preferred embodiment of the present invention is described below with reference to the accompanying drawings.

Figure 1:
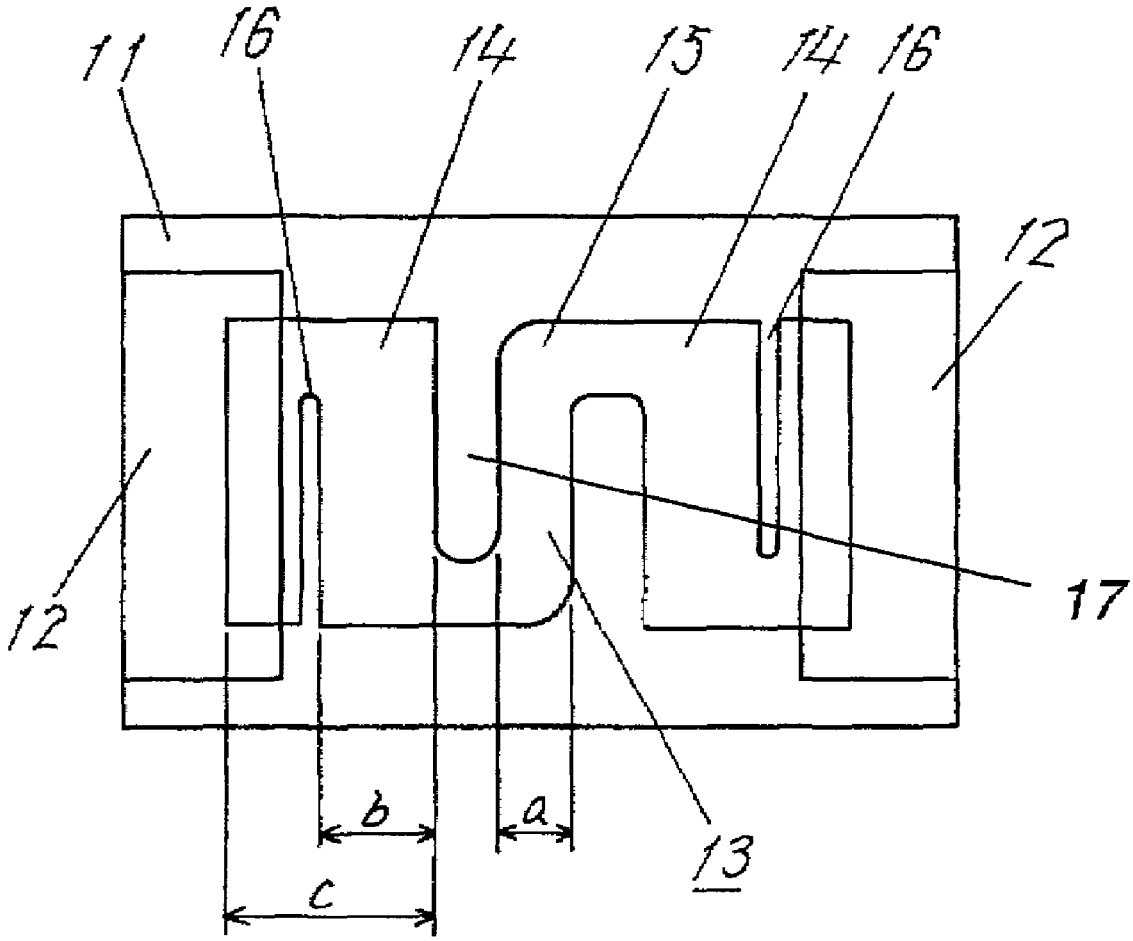
FIG. 1 is a plan view of a chip resistor in accordance with a preferred embodiment of the present invention.
Figure 2:
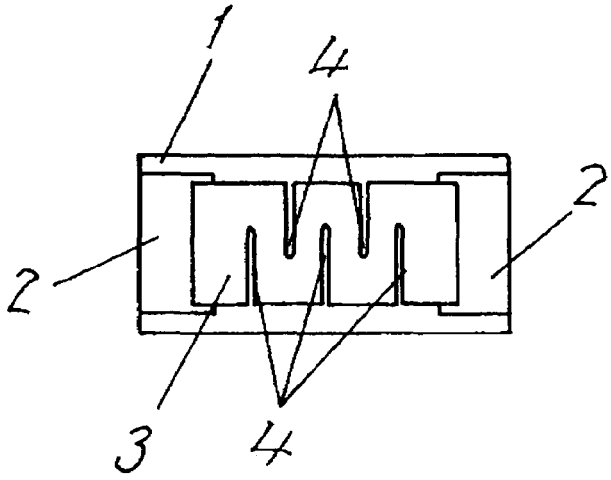
PRIOR ART FIG. 2
FIG. 2 is a plan view of a prior art chip resistor
Figure 3:
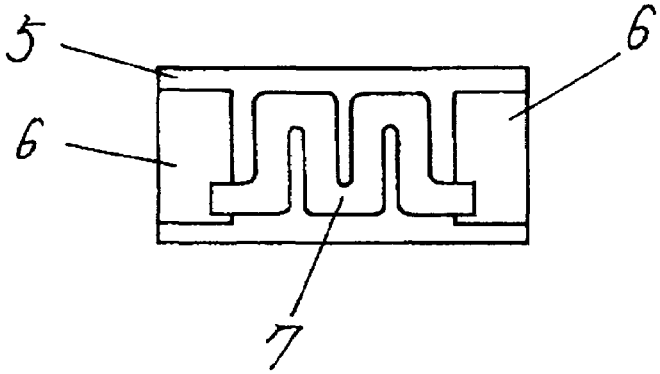
FIG. 3 PRIOR ART
FIG. 3 is a plan view of another prior art chip resistor
Figure 4:
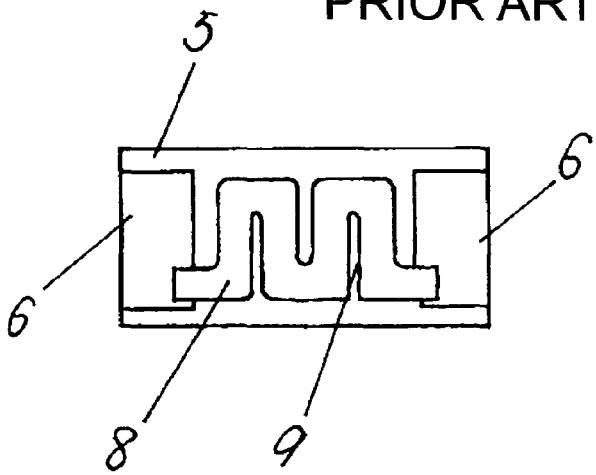
PRIOR ART FIG. 4
FIG. 4 is a plan view of still another prior art chip resistor

FIG. 1 is a plan view of the chip resistor in accordance with the preferred embodiment of the present invention.

In FIG. 1, an alumina substrate 11 has rectangular shape on a flat face, and its outside dimension is 2012 (2.0 mm×1.25 mm). On both ends on one face of the substrate 11 are a pair of electrodes 12.

A resistor element 13 is formed bridging between the pair of electrodes 12. The resistor element 13 comprises rectangular sections 14 which are connected to the electrodes 12 and a S-shape section 15 disposed between the rectangular sections 14 and which are free of trimming portion such as trimming grooves. The width "c" of the rectangular sections 14 is twice as wide as the width "a" of the S-shaped section 15. Due to this, the resistor element 13 becomes longer, improving the surge property.

The width "a" of the S-shape section 15 is preferably 150 μm or wider. In this embodiment, the width "a" of the S-shape section 15 is set at 150 μm and the width "c" of the rectangular sections 14, 350 μm. The width of a space 17 between the rectangular sections 14 and the S-shaped section 15 is 150 μm.

When the thickness of the resistor element 13 is made such that the rectangular sections 14 have a thickness twice as thick as the S-shape section 15, a sufficient sectional area of the resistor element 13 for maintaining surge properties even when a trimming groove (described later) is provided by trimming in the rectangular sections 14 is obtained. As such, this construction provides a desirable surge property. In this embodiment, the thickness of the S-shape section 15 is set at 7 μm and the rectangular sections 14, 14 μm.

A trimming groove 16 is provided to one of the two rectangular sections 14. The width "b" of the rectangular section 14 provided with the trimming groove 16, where the rectangular section 14 extends to the S-shape section 15 is wider than the width a of the S-shaped section 15. The reason for this is that since the laser trimming changes the resistive characteristics of the resistor element 13 in the vicinity of the trimming groove 16, if the width b of the rectangular section 14 extending to the S-shaped section 15 is narrower than the width "a" of the S-shaped section 15, an electrical load concentrates around the trimming groove 16 when a surge is applied, thereby damaging the resistor element 13.

In the preferred embodiment of the present invention, since the trimming groove 16 is provided to at least one of the rectangular sections 14, the chip resistor does not experience a concentrated load even when a surge is applied to it. Further, in this embodiment, the rectangular sections 14 are twice as thick as the S-shaped section 15. Therefore, even when the trimming groove 16 is provided to the rectangular sections 14, the cross section of the resistor element 13 is large enough to support the surge property. Thus, a desirable surge property can be obtained. It is preferable to set the width "b" at the rectangular section 14 extending to the S-shaped section 15 at 200 μm or wider, to prevent the change in resistance characteristics of the resistor element 13 caused by heat applied during the laser trimming.

The following is a description of a method of manufacturing the chip resistor of the preferred embodiment of the present invention.

First, an electrode paste is screen printed on both ends of the alumina substrate 11 and fired at 850° C. to form the pair of electrodes 12.

Second, a resistor paste is screen printed between the electrodes 12, and fired at 850° C. to form the resistor element 13. The resistor element 13 comprises the rectangular sections 14 connected to the pair of electrodes 12 and the S-shape section 15 which is located between the rectangular sections 14 and is free of trimming groove. This construction allows the resistor element 13 to maintain its length even when its position is not properly aligned during the screen printing. In addition, the construction allows enough space to form the trimming groove.

Third, the trimming groove 16 is formed by the laser trimming on at least one of the rectangular sections 14 to adjust the resistance. Formation of the trimming groove extends the length of the resistor element 13, thus the surge property is further improved. Since the trimming groove 16 helps to adjust the resistance as well, a chip resistor with highly accurate resistance can be provided. The trimming of the rectangular sections 14 also increases the ratio of resistance adjustment, thereby improving production yields.

The materials used for the manufacturing method described above for the chip resistor of this embodiment can be replaced with other materials. For example, if the resistor element is made of a metallic thin film of Ni/Cr, the same effect can be obtained.

As thus far described, the resistor of the present invention comprises a substrate, a pair of electrodes disposed on the substrate, and a resistor element disposed between the electrodes. The resistor element comprises rectangular sections which are connected to the electrodes and a S-shaped section disposed between the rectangular sections, and is free of trimming groove. According to this construction, since the trimming groove is provided to at least one of the rectangular sections, the resistance can be adjusted, improving accuracy of the resistance of the resistor. Further, the resistor element comprises the rectangular sections where the length of the resistor element is extended when trimming is done and the S-shaped section which is free from trimming groove, a chip resistor with a superior surge property can be obtained. Furthermore, since the ratio of resistance adjustment can be made large, the yield of production improves.

What is claimed is:

1. A resistor comprising:

a substrate having a width shorter than a length of said substrate;

a pair of electrodes disposed on said substrate, said pair of electrodes being disposed on both end portions of said substrate along a substantial portion of said width;

a resistor element disposed between said pair of electrodes, said resistor element including:

side sections, each of said side sections connected to each of said pair of electrodes along a substantial portion of a length of said pair of electrodes along said width, and a single S-shaped section disposed between said side sections, a trimming portion formed within at least one of said side sections, a space located between said S-shaped section and said side sections, wherein, said S-shaped section being away from said trimming portion, and highest levels of said substrate are lower at said trimming portion than at said space.

2. The resistor of claim 1, wherein a width of at least one of said side sections of said resister is wider than a width of said S-shaped section.

3. The resistor of claim 1, wherein thickness of said side sections of said resistor element are twice as thick as said S-shaped section.

4. The resistor of claim 1, wherein a width of said side section of said resistor element where the side section extends to said S-shape section is wider than a width of said S-shaped section.

5. The resistor of claim 1, wherein said side sections are rectangular.

6. A resistor according to claim 1, wherein one of said trimming portions is closer to one of said electrodes than to said space.

7. The resistor of claim 1, wherein said substantial portion of said length is a majority of said length.

8. A method of manufacturing a resistor comprising the steps of:

forming a pair of electrodes on a substrate having a width shorter than a length of said substrate; and forming a resistor element between said pair of electrodes, said resistor element comprising i) side sections connected to each of said pair of electrodes along a substantial portion of a length of said pair of electrodes along a width, ii) not more than a single S-shaped section disposed between said side sections, and a space between said side sections and said S-shaped section; and trimming at least one of said side sections to form a trimming portion to adjust a resistance, wherein said S-shaped section is away from said trimming portion.

9. The method of manufacturing a resistor of claim 8, wherein said side sections are rectangular.

10. The method of claim 8, wherein said substantial portion of said length is a majority of said length.

11. A resistor comprising:

a substrate having a width shorter than a length of said substrate;

a pair of electrodes disposed on said substrate, said pair of electrodes being disposed on both end portions of said substrate along said width;

a resistor element situated between said pair of electrodes, said resistor element including:

a pair of side sections, each of said side sections connected to a respective one of said pair of electrodes along a substantial portion of a length of said pair of electrodes along said width, and an S-shaped section situated between said pair of side sections;

a trimming portion formed within at least one of said side sections;

a space defined by said S-shaped section and said side sections;

highest levels of said substrate are lower at said trimming portion than at said space;

wherein a width of said S-shaped section along said length of said substrate is less than a width of each of said side sections along said length of said substrate.

12. The resistor of claim 11, wherein each of said side section includes a respective trimming groove formed therein.

13. The resistor of claim 12, wherein said S-shaped section is free of trimming grooves.

14. The resistor of claim 11, wherein said S-shaped section is free of trimming grooves.

15. The resistor of claim 11, wherein said substantial portion of said length is a majority of said length.

16. A resistor comprising:

a substrate having a width shorter than a length of said substrate;

a pair of electrodes disposed on said substrate, said pair of electrodes being disposed on both end portions of said substrate along a substantial portion of said width;

a resistor element disposed between said pair of electrodes, said resistor element including:

side sections, each of said side sections connected to each of said pair of electrodes along a substantial portion of a length of said pair of electrodes along said width, and an S-shaped section disposed between said side sections, trimming portions formed within said side sections, a space defined by said S-shaped section wherein said S-shaped section loops about said space, said space between said trimming portions, highest levels of said substrate are lower at said trimming portion than at said space.

17. A method of manufacturing a resistor comprising the steps of:

forming a pair of electrodes on a substrate having a width shorter than a length of said substrate; and forming a resistor element by printing between said pair of electrodes to form said resistor element comprising i) side sections connected to each of said pair of electrodes along a substantial portion of a length of said pair of electrodes along a width of said substrate and ii) an S-shaped section disposed between said side sections, said S-shaped section looping around a space; and trimming said side sections to adjust a resistance so that said space is between areas where said trimming occurs wherein, during trimming, a portion of said substrate is removed so that highest levels of said substrate are lower at said trimming portion than at said space.

18. A resistor comprising:

a substrate having a width shorter than a length of said substrate;

a pair of electrodes disposed on said substrate, said pair of electrodes being disposed on both end portions of said substrate along said width;

a resistor element situated between said pair of electrodes, said resistor element including:

a pair of side sections, each of said side sections connected to a respective one of said pair of electrodes along a substantial portion of a length of said pair of electrodes along said width, and an S-shaped section situated between said pair of side sections, trimming portions formed within said side sections, a space defined by said S-shaped section wherein said S-shaped section loops about said space, said space between said trimming portions, highest levels of said substrate are lower at said trimming portion than at said space, wherein a width of said S-shaped section along said length of said substrate is less than a width of each of said side sections along said length of said substrate.

* * * * *